US012025347B2

(12) United States Patent
Jayarathne

(10) Patent No.: US 12,025,347 B2
(45) Date of Patent: Jul. 2, 2024

(54) CONDENSATE DRAIN SYSTEM FOR A FURNACE

(71) Applicant: Johnson Controls Tyco IP Holdings LLP, Milwaukee, WI (US)

(72) Inventor: Madhuka M. Jayarathne, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 17/562,840

(22) Filed: Dec. 27, 2021

(65) Prior Publication Data

US 2022/0163236 A1 May 26, 2022

Related U.S. Application Data

(63) Continuation of application No. 16/352,416, filed on Mar. 13, 2019, now Pat. No. 11,209,187.
(Continued)

(51) Int. Cl.
*F24D 19/08* (2006.01)
*F24D 5/00* (2022.01)
(Continued)

(52) U.S. Cl.
CPC ..... *F24H 8/006* (2013.01); *F24D 5/00* (2013.01); *F24D 19/088* (2013.01);
(Continued)

(58) Field of Classification Search
CPC .... F24F 2013/227; F24F 13/222; F24F 13/22; F24F 1/42; F24H 9/16; F24H 9/165; F24H 9/088; F24H 9/2085; F24H 3/025; F24H 3/065; F24H 3/006; F24D 5/12; F24D 5/00; F24D 5/04; F24D 19/1084; F24D 19/1015; F24D 7/00; F24D 9/00
USPC ..... 126/99 R, 116 A, 116 R, 114; 62/286, 62/285
IPC ..... F24D 19/08,5/04, 5/12, 19/10, 7/00, F24D 9/00; F24F 13/22, 3/08, 3/10, 1/42; F24H 9/16, 9/20, 3/08, 3/10
See application file for complete search history.

(56) References Cited

U.S. PATENT DOCUMENTS 4,515,145 A * 5/1985 Tallman ..... F24H 3/065 126/109
4,937,559 A * 6/1990 Meacham ..... F24F 13/22 200/61.04
(Continued)

FOREIGN PATENT DOCUMENTS

EP 1741994 A1 * 1/2007 ..... F24F 13/222
FR 2694074 A1 * 1/1994 ..... F24H 8/003
(Continued)

*Primary Examiner* — Steven B McAllister
*Assistant Examiner* — Daniel E. Namay
(74) *Attorney, Agent, or Firm* — Fletcher Yoder, PC

(57) ABSTRACT

A condensate drain system for a heating, ventilation, and/or air conditioning (HVAC) system includes a heat exchanger having a plurality of tubes configured to receive ambient air and fluidly coupled to a drain via a conduit, a valve positioned along the conduit between the plurality of tubes and the drain, where the valve is configured to enable a flow of condensate from within the plurality of tubes toward the drain in an open position and the block the flow in a closed position, and a controller configured to adjust a position of the valve based on feedback indicative of an operational state of the HVAC system.

20 Claims, 6 Drawing Sheets

Related U.S. Application Data

(60) Provisional application No. 62/808,559, filed on Feb. 21, 2019.

(51) Int. Cl.
*F24F 13/22* (2006.01)
*F24H 8/00* (2022.01)
*F24H 9/16* (2022.01)
*F24D 7/00* (2022.01)

(52) U.S. Cl.
CPC ..... *F24F 13/222* (2013.01); *F24H 9/16* (2013.01); *F24D 7/00* (2013.01); *F24F 2013/227* (2013.01)

(56) References Cited

U.S. PATENT DOCUMENTS 5,524,606 A * 6/1996 Le Strat ..... F24H 3/065 126/92 C
6,442,956 B1 * 9/2002 Herren ..... F24F 13/222 62/272
7,191,606 B1 * 3/2007 Dwyer ..... F24F 13/222 62/150
8,156,956 B1 * 4/2012 Coogle ..... F16L 55/07 137/271
8,840,729 B1 * 9/2014 Herren ..... F24F 13/222 137/112
9,975,152 B1 * 5/2018 McClarren ..... F24F 13/222
10,168,114 B2 * 1/2019 Zager ..... F28D 1/047
10,584,896 B2 * 3/2020 Wilson ..... F24F 1/00
10,941,991 B2 * 3/2021 Zager ..... F02B 29/0468
2006/0288709 A1 * 12/2006 Reidy ..... F25B 21/02 62/3.4
2011/0283730 A1 * 11/2011 Tudor ..... F24F 13/222 62/291
2014/0034038 A1 * 2/2014 Sherrow ..... F24H 8/006 126/114
2014/0130888 A1 * 5/2014 Kaiser ..... B08B 9/032 137/246.22
2014/0331698 A1 * 11/2014 Daley ..... F24F 13/224 62/291
2016/0363344 A1 * 12/2016 Chen ..... F24H 9/2021
2017/0045282 A1 * 2/2017 Thornberry, Jr. ..... F15D 1/0025
2018/0031275 A1 * 2/2018 Wilson ..... F24F 5/00
2018/0058779 A1 * 3/2018 Zager ..... F28F 17/005
2018/0224174 A1 * 8/2018 Hollander ..... F24F 1/0007
2019/0003788 A1 * 1/2019 Zager ..... F28D 1/047
2021/0131083 A1 * 5/2021 Shelton ..... E03C 1/306

FOREIGN PATENT DOCUMENTS

FR 2944481 A1 * 10/2010 ..... B60H 1/3233
JP 2517958 Y2 * 1/1991 ..... F25B 15/00
JP H08312993 A * 5/1995 ..... F24F 3/153
JP 08312993 A * 11/1996 ..... F24F 3/153
JP 2001141257 A * 5/2001 ..... F24F 1/00
JP 2014184952 A * 10/2014 ..... B60H 1/3233
JP 2018036044 A * 3/2018 ..... F02B 29/0468

* cited by examiner

CONDENSATE DRAIN SYSTEM FOR A FURNACE

CROSS REFERENCE TO RELATED APPLICATIONS

This is a continuation application of U.S. patent application Ser. No. 16/352,416 entitled, "CONDENSATE DRAIN SYSTEM FOR A FURNACE," filed Mar. 13, 2019, which claims priority from and the benefit of U.S. Provisional Application No. 62/808,559, entitled "CONDENSATE DRAIN SYSTEM FOR A FURNACE," filed Feb. 21, 2019, each of which is hereby incorporated by reference in its entirety for all purposes.

BACKGROUND

The present disclosure relates generally to a heating, ventilation, and/or air conditioning (HVAC) system, and more particularly, to a condensate drain system for a furnace of an HVAC system.

HVAC systems are utilized in residential, commercial, and industrial environments to control environmental properties, such as temperature and humidity, for occupants of the respective environments. The HVAC system may control the environmental properties through control of an air flow delivered to the environment. In some cases, the HVAC system includes a furnace configured to combust a mixture of air and fuel to generate and transfer thermal energy to the air flow that is ultimately delivered to the environment. The furnace may intake ambient air into tubes of the furnace and inject a fuel into the tubes to form the mixture of air and fuel. The mixture of air and fuel may ultimately combust upon exposure to a flame or spark. During periods of warm weather, the furnace may be shut off or inactive, and a vapor compression system of the HVAC system may circulate a refrigerant through a heat exchanger to reduce a temperature of the air flow delivered to the environment. The air flow that is conditioned by the vapor compression system may be directed across tubes of the inactive furnace, which may include the ambient air. Unfortunately, the conditioned air from the vapor compression system may cause moisture within the ambient air to condense in the tubes of the furnace, which may affect operation of the furnace.

SUMMARY

Figure 1:
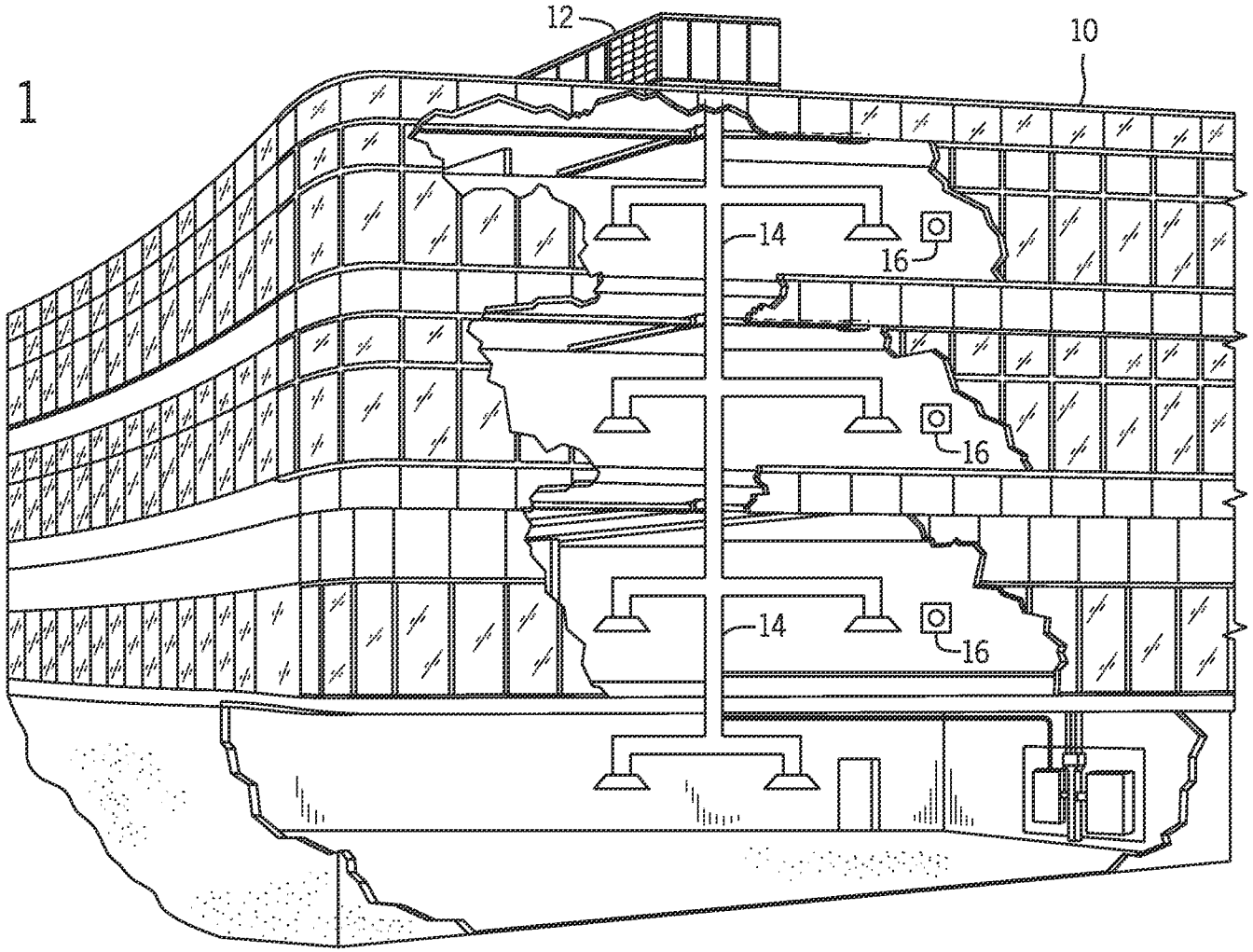
FIG. 1 is a schematic of an embodiment of an HVAC system for building environmental management that includes an HVAC unit, in accordance with an aspect of the present disclosure.

In one embodiment of the present disclosure, a condensate drain system for a heating, ventilation, and/or air conditioning (HVAC) system includes a heat exchanger having a tube configured to receive ambient air and fluidly coupled to a drain via a conduit, a valve positioned along the conduit between the tube and the drain, where the valve is configured to enable a flow of condensate from within the tube toward the drain in an open position and block the flow in a closed position, and a controller configured to adjust a position of the valve based on feedback indicative of an operational state of the HVAC system.

In another embodiment of the present disclosure, a heating, ventilation, and/or air conditioning (HVAC) system includes manifold configured to flow combustion gases generated in a heating mode of the HVAC system and including a port configured to receive ambient air into the manifold, a plurality of tubes disposed within a flow path of an air flow and in fluid communication with the manifold, a condensate drain system having a drain conduit fluidly coupled to the plurality of tubes and a valve configured to enable a flow of condensate from the plurality of tubes toward a drain, a controller configured to adjust a position of the valve based on feedback indicative an operational state of the heating mode.

In a further embodiment of the present disclosure, a heating, ventilation, and air conditioning (HVAC) system includes an air handler having an air passage configured to direct an air flow toward an environment to be conditioned by the HVAC system, a first heat exchanger disposed within the air handler of the HVAC system, where the first heat exchanger is configured to direct a working fluid therethrough to enable heat exchange between the working fluid and the air flow, a second heat exchanger disposed within the air handler of the HVAC system, downstream of the first heat exchanger with respect to the air flow, where the second heat exchanger includes a plurality of tubes configured to receive ambient air, a condensate drain system having a conduit fluidly coupled to the plurality of tubes of the second heat exchanger and a valve disposed along the conduit, where the valve is configured to control a flow of condensate from the plurality of tubes of the second heat exchanger toward a drain, and a controller configured to adjust a position of the valve based on feedback indicative of a heating call of the HVAC system and based on feedback indicative of a cooling call of the HVAC system.

Other features and advantages of the present application will be apparent from the following, more detailed description of the embodiments, taken in conjunction with the accompanying drawings which illustrate, by way of example, the principles of the application.

DETAILED DESCRIPTION

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a condensate drain system for a furnace of a heating, ventilation, and/or air conditioning (HVAC) system. As set forth above, condensate may collect within tubes of the furnace as air conditioned by a vapor compression system of the HVAC system is directed across the tubes of the furnace when the furnace is in an inactive state. For example, in an active state, the tubes of the furnace intake ambient air and fuel to form a mixture of air and fuel, which combusts upon exposure to a flame. As such, hot combustion gases are formed within the tubes of the furnace and are used to transfer thermal energy to an air flow directed to an environment conditioned by the HVAC system. When the furnace is in the inactive state, ambient air may still be present within the tubes. Ambient air may include moisture, and thus, as air conditioned by the vapor compression system is directed across the tubes of the furnace, moisture from the ambient air may condense and collect within the tubes of the inactive furnace. Specifically, the vapor compression system may include a heat exchanger disposed upstream of the furnace, relative to the direction of air flow, and the heat exchanger may cool the air before the air is directed across the tubes of the furnace. Thus, the conditioned air may cool the ambient air within the tubes of the furnace, which may result in formation of condensate within the tubes. The condensate accumulating within the tubes of the furnace may cause existing HVAC systems to operate less efficiently upon transition of the furnace from the inactive state to the active state. As used herein, "tube" or "tubes" may refer to any conduit, passageway, and/or duct having any suitable geometry, such as cylindrical and/or prismatic, and including any suitable material, such as metallic, polymeric, and/or another suitable material.

Accordingly, embodiments of the present disclosure are directed to a condensate drain system for a furnace of an HVAC system. For instance, a valve, such as a solenoid valve, may be fluidly coupled to the tubes of the furnace to enable drainage of condensate from the tubes. The valve may be selectively opened and closed based on an operating mode or call of the HVAC system. In some embodiments, the valve may be in a closed position when the HVAC system operates in a heating mode, when the furnace is active, and/or when the HVAC system is not in a cooling mode. The valve may be adjusted to an open position upon activation of the cooling mode of the HVAC system in order to enable drainage of any condensate that forms within the tubes of the furnace. The condensate may be directed to a drain, such as a drain pan, a condensate collector, an outlet of the HVAC system, and/or another suitable component of the HVAC system, to recycle and/or remove the condensate from the tubes of the furnace. As such, an operational life of the furnace may be increased and/or operation of the HVAC system may be improved. For example, the condensate drain system may improve efficiency of HVAC system operation.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
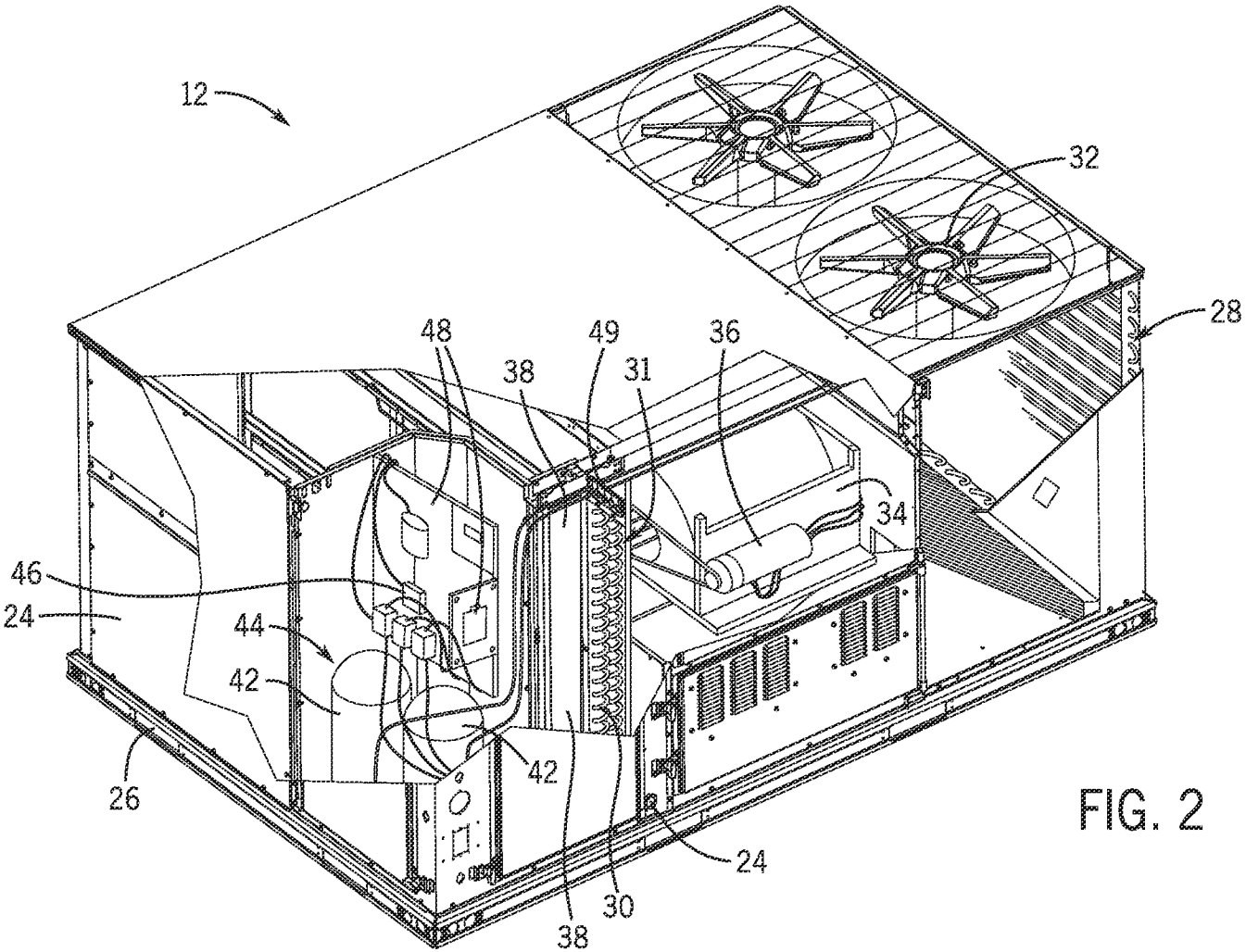
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
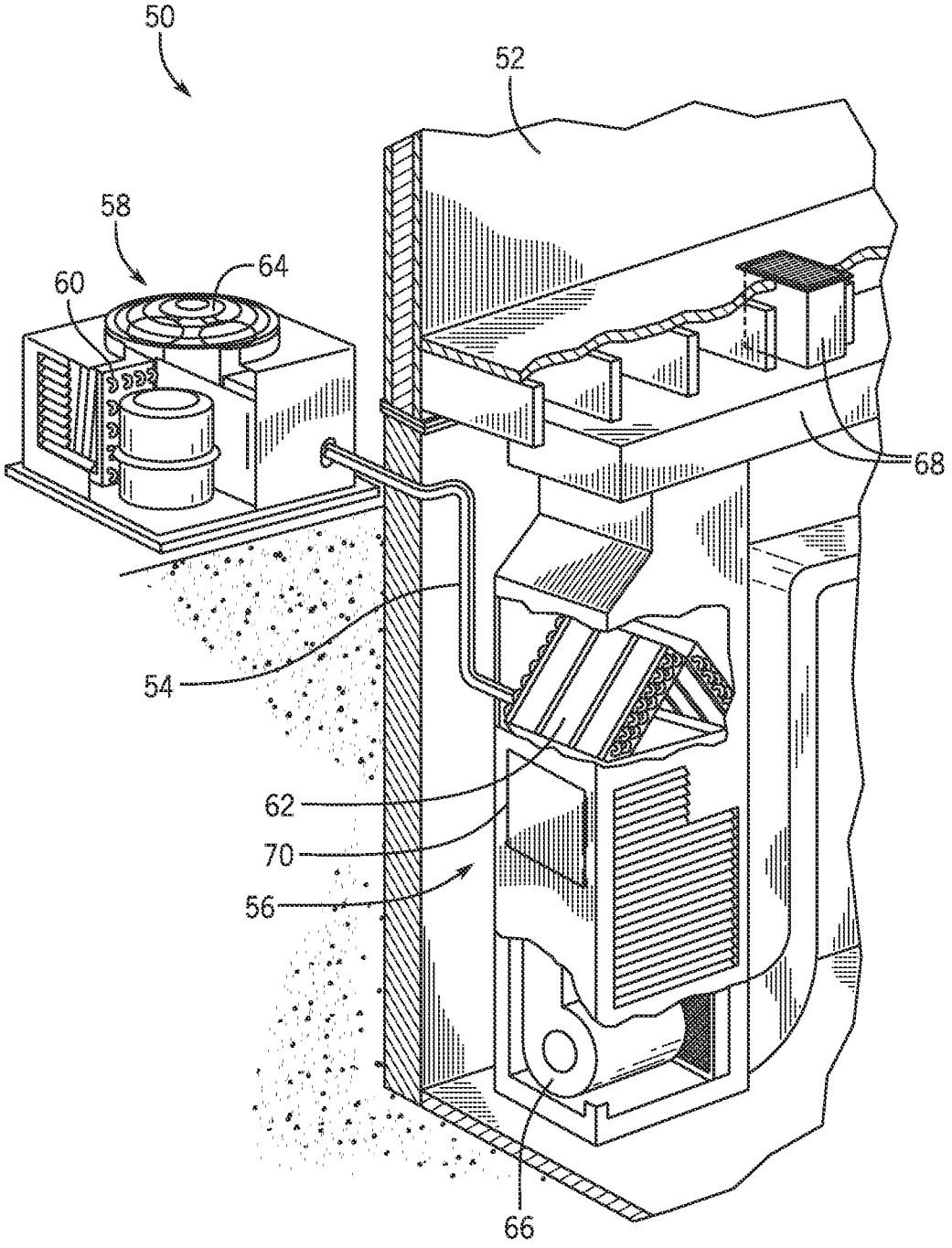
FIG. 3 is a cutaway perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
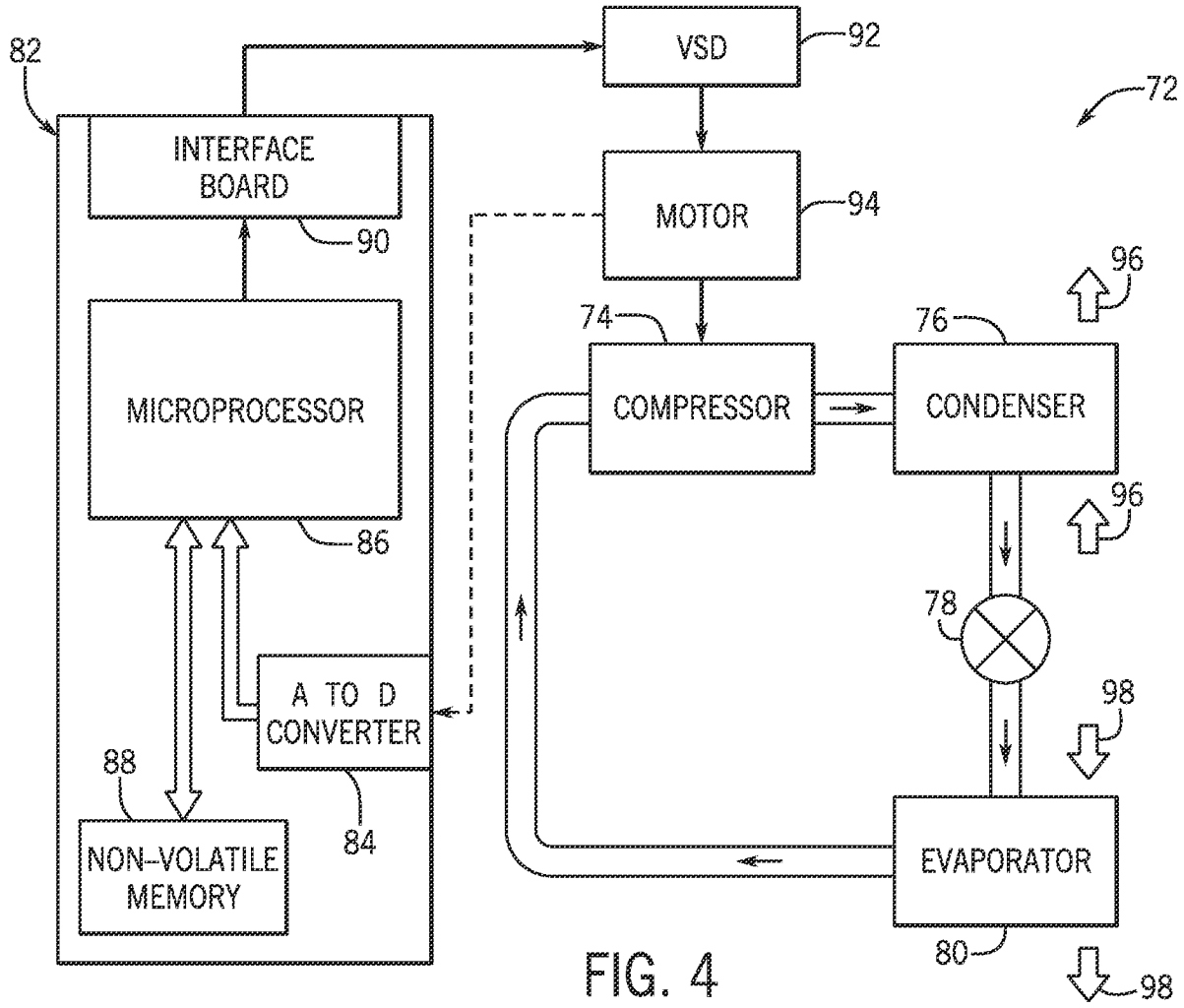
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a condensate drain system for a furnace of an HVAC system, such as the HVAC unit 12 and/or the residential heating and cooling system 50. In existing HVAC systems, condensate may accumulate within tubes of a furnace as cool, conditioned air flows across the tubes of the furnace. For example, the conditioned air flowing across the tubes of the furnace may be cooled by a vapor compression system disposed upstream of the furnace, relative to a direction of air flow, before the conditioned air is directed across the tubes of the furnace. While in an inactive state, the furnace may still receive or otherwise be exposed to ambient air via an air intake of the furnace. The ambient air may contain moisture, which may condense within the tubes of the furnace upon transferring thermal energy to the cool, conditioned air. Existing HVAC systems may be unable to remove the condensate within the tubes of the furnace, which may impact operation and/or lower the efficiency of the furnace, such as when the furnace transitions between the inactive state and an active state. Accordingly, embodiments of the present disclosure are directed to a condensate drain system for a furnace that enables drainage of condensate collecting within the tubes of the furnace. For example, the condensate drain system may be configured to direct condensate from within the tubes to another suitable location within or external to the HVAC system. This system may enable the furnace to be substantially free of condensate upon a demand for heat within an environment to be conditioned by the HVAC system, thereby increasing an efficiency of the furnace.

Figure 5:
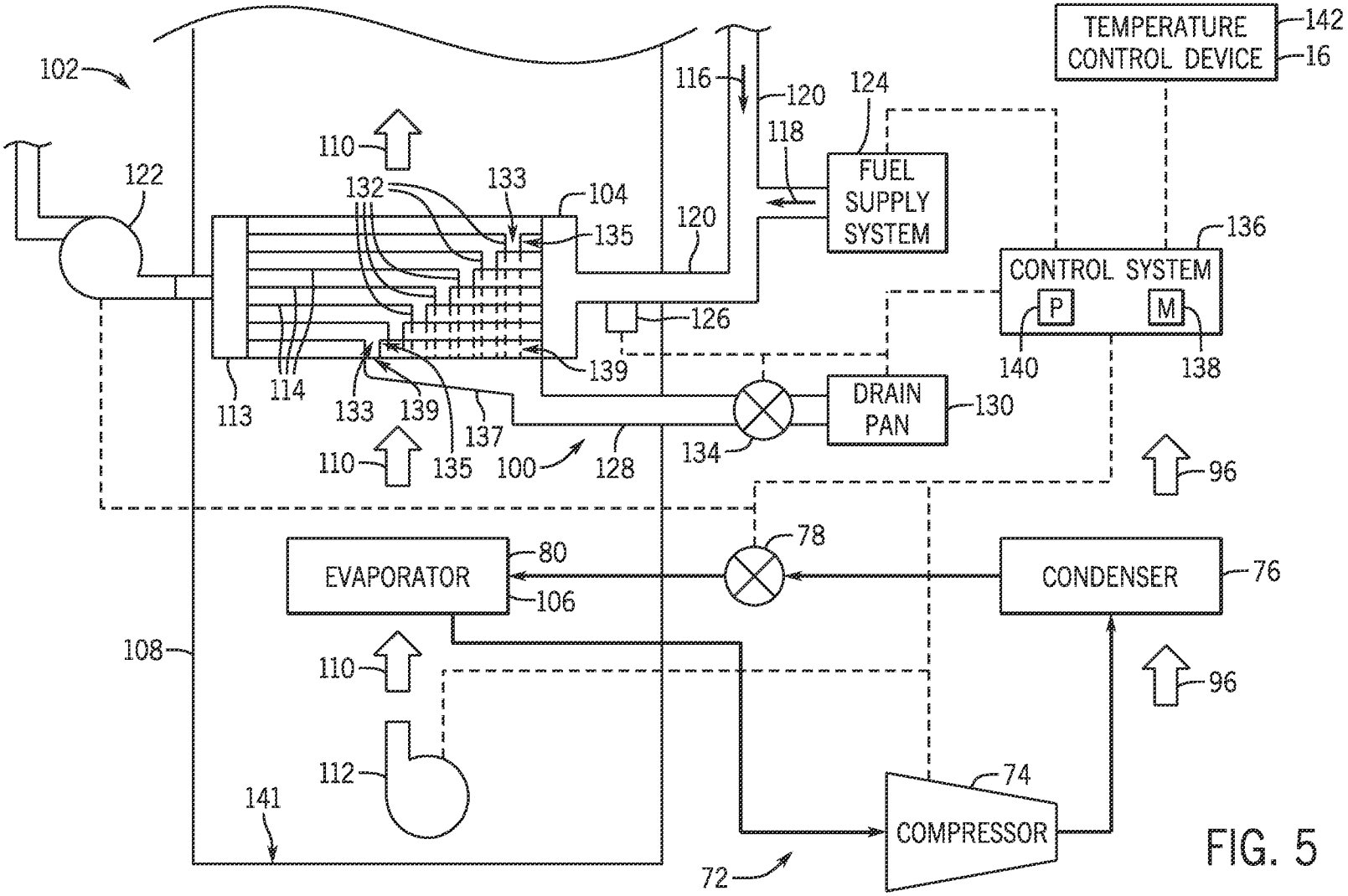
FIG. 5 is a schematic of an embodiment of an outdoor unit of an HVAC system having a furnace, a vapor compression system, and a condensate drain system, in accordance with an aspect of the present disclosure.

For example, FIG. 5 is a schematic of an embodiment of a condensate drain system 100 for an HVAC system 102, such as the HVAC unit 12 and/or the residential heating and cooling system 50. As shown in the illustrated embodiment of FIG. 5, the HVAC system 102 includes a furnace 104 and an evaporator 106, such as the evaporator 80, disposed within an air handler 108, housing, or duct configured to direct an air flow 110 toward an environment to be conditioned by the HVAC system 102. The air handler 108 includes a blower 112 configured to direct the air flow 110 sequentially through or across the evaporator 106 and the furnace 104, thereby placing the air flow 110 in a heat exchange relationship with a refrigerant flowing through the evaporator 106 and/or a working fluid flowing through the furnace 104. As such, the HVAC system 102 may be configured to cool the air flow 110 as refrigerant flows through the evaporator 106 via heat transfer from the air flow 110 to the refrigerant. Similarly, the HVAC system 102 is configured to heat the air flow 110 as working fluid flows through the furnace 104 via heat transfer from the working fluid to the air flow 110. In some embodiments, the evaporator 106 is a component of the vapor compression system 72, which may be configured as a heat pump. In such embodiments, the evaporator 106 may also act as a condenser when a flow direction of the refrigerant is reversed through the vapor compression system 72. Thus, the furnace 104 and the evaporator 106 may individually or collectively heat the air flow 110 via heat transfer from the working fluid and/or from the refrigerant to the air flow 110.

In any case, the furnace 104 may include a heat exchanger 113 having a plurality of tubes 114 that are configured to flow the working fluid, such as combustion gases. For example, the tubes 114 of the furnace 104 receive a mixture of supply air 116, which may be ambient or outdoor air, and fuel 118 via an inlet conduit 120, or manifold. The supply air 116 may be drawn into the tubes 114 of the furnace 104 via a fan 122, such as a draft inducer blower, and the fuel 118 may be injected and/or mixed with the supply air 116 via a fuel supply system 124. The fuel supply system 124 may include fuel nozzles, pumps, and/or other components that direct a target amount of fuel 118 into the inlet conduit 120, which may be based on a speed of the fan 122 and/or a flow rate of the supply air 116. The furnace 104 may also include a burner 126 that is configured to provide a spark or flame that combusts the mixture of supply air 116 and fuel 118 to produce the combustion gases. As such, hot combustion gases are directed through the plurality of tubes 114 of the furnace 104 to transfer thermal energy to the air flow 110.

In some cases, the furnace 104 may be shut off or placed in an inactive state. For example, the environment to be conditioned by the HVAC system 102 may incur a demand for cool air to reduce a temperature within the environment. As such, the fan 122 of the furnace 104 may be shut off, but ambient air may still enter the tubes 114 of the furnace 104 through the inlet conduit 120 via diffusion. The ambient air may include moisture or water particles that may condense as cool, conditioned air discharged from the evaporator 106 flows across the tubes 114 of the furnace 104. The condensate may accumulate within the tubes 114 of the furnace 104, which may affect an operation or efficiency of the furnace 104 upon transitioning to an active state from the inactive state. Accordingly, the furnace 104 includes a drain conduit 128 of the condensate drain system 100 that is configured to direct the condensate out of the tubes 114 and toward a drain 130, such as a drain pan, a condensate collector, an outlet of the HVAC system 102, and/or another suitable component, which is configured to recycle and/or dispose of the condensate. For instance, in some embodiments, the drain 130 may collect the condensate from the furnace 104 and utilize the condensate to supplement cooling of the vapor compression system 72 via adiabatic cooling. In other embodiments, the drain 130 may otherwise remove the condensate and direct the condensate out of the HVAC system 102.

As shown in the illustrated embodiment of FIG. 5, the drain conduit 128 may be fluidly coupled to each tube of the plurality of tubes 114 of the furnace 104. For example, the drain conduit 128 may be fluidly coupled to individual condensate channels 132 of the respective tubes 114. The condensate channels 132 may direct a flow of the condensate from openings 133 extending through the plurality of tubes 114 toward the drain conduit 128. For example, each condensate channel 132 may be coupled to a respective opening 133 at a first end 135 of the condensate channel 132 and coupled to a trough 137 at a second end 139 of the condensate channel 132. The trough 137 may be sloped with respect to a base 141 of the HVAC system 102 and/or the ground to facilitate a flow of condensate from the condensate channels 132 into the drain conduit 128. Additionally or alternatively, the plurality of tubes 114 may be angled with respect to the base 141 of the HVAC system 102 and/or the ground in order to direct the flow of condensate toward the drain conduit 128 via gravity. In any case, the drain conduit 128 includes a valve 134 that may be configured to control a flow of the condensate from each tube of the plurality of tubes 114 toward the drain 130. In some embodiments, the valve 134 is a solenoid valve, a butterfly valve, a ball valve, or another suitable valve. For example, the valve 134 may be a normally closed solenoid valve that biased toward a closed position. While the illustrated embodiment of FIG. 5 shows the furnace 104 having a single valve 134 and a single drain conduit 128 coupled to each of the individual condensate channels 132, in other embodiments, the furnace 104 may include any suitable number of drain conduits 128 and valves 134 configured to direct a flow of condensate from the plurality of tubes 114 to the drain 130.

In any case, the valve 134 may be communicatively coupled to a control system 136, such as the control board 48 and/or the control panel 82. The control system 136 may include a memory 138 and a processor 140. The memory 138 may be a mass storage device, a flash memory device, removable memory, or any other non-transitory computer-readable medium that includes instructions for the processor 140 to execute. The memory 138 may also include volatile memory such as randomly accessible memory (RAM) and/or non-volatile memory such as hard disc memory, flash memory, and/or other suitable memory formats. The processor 140 may execute the instructions stored in the memory 138, in order to adjust operation of the components of the HVAC system 102, such as the valve 134.

In some embodiments, the control system 136 is communicatively coupled to components of the vapor compression system 72, such as the compressor 74, the expansion valve or device 78, and/or the blower 112, and/or components of the furnace 104, such as the fan 122, the fuel supply system 124, and/or the burner 126. Additionally or alternatively, the control system 136 is communicatively coupled to a temperature control device 142, such as the control device 16, configured to monitor a temperature within the environment to be conditioned. As such, the control system 136 may receive feedback indicative of a load demand within the environment. For example, the control system 136 may determine whether a temperature within the environment should be reduced or increased based on a temperature set point of the environment. Thus, the control system 136 determines an operating mode, call, and/or status of the HVAC system 102, such as whether the HVAC system 102 is or should be operating in a cooling mode, a heating mode, a ventilation mode, an idle mode, or another suitable mode. The control system 136 may adjust a position of the valve 134 based on the operating mode of the HVAC system 102. For example, the control system 136 may adjust the valve 134 toward a closed position during a heating mode or when the furnace 104 is operating. Accordingly, combustion gases that may be flowing within the plurality of tubes 114 of the furnace 104 are not directed toward the drain 130 via the drain conduit 128 or otherwise away from the plurality of tubes 114 of the furnace 104. When the control system 136 determines that the HVAC system 102 is or should be operating in the cooling mode, the control system 136 may adjust the valve 134 toward an open position to enable condensate that may accumulate within the plurality of tubes 114 to be directed toward the drain 130 via the drain conduit 128.

Figure 6:
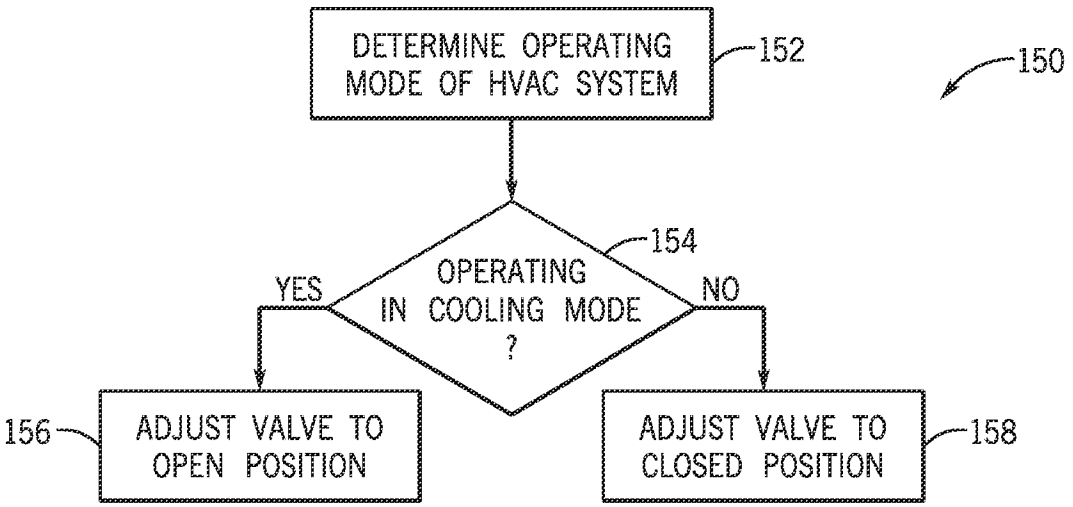
FIG. 6 is block diagram of an embodiment of a process for controlling a condensate drain system of the furnace of FIG. 5, in accordance with an aspect of the present disclosure.

For example, FIG. 6 is a flow chart of an embodiment of a process 150, algorithm, or control logic for controlling the valve 134. At block 152, the control system 136 determines an operating mode of the HVAC system 102. As set forth above, the HVAC system 102 may include a cooling mode, where the vapor compression system 72 circulates refrigerant through the evaporator 106 to absorb thermal energy from the air flow 110 in order to supply cool air flow 110 to reduce a temperature within the environment. The HVAC system 102 may also include a heating mode, where the furnace 104 combusts the mixture of supply air 116 and fuel 118 to transfer thermal energy to the air flow 110 in order to supply warm air flow 110 to increase a temperature within the environment. Further still, the HVAC system 102 may include a combined heating mode, where both the furnace 104 and the vapor compression system 72 operate to transfer thermal energy to the air flow 110. In the combined heating mode, the evaporator 106 operates as a condenser in order to transfer thermal energy to the air flow 110. In such an embodiment, the vapor compression system 72 may be a heat pump that is configured to reverse a flow of the refrigerant through the components of the vapor compression system 72 to operate in both the cooling mode and the combined heating mode. The HVAC system 102 may also include a ventilation mode, whereby the HVAC system 102 directs the air flow 110 to the environment without operating the furnace 104 and/or the vapor compression system 72. In other words, the blower 112 may direct the air flow 110 toward the environment, but the refrigerant and the working fluid do not flow through the evaporator 106 and the furnace 104, respectively, to condition the air flow 110. Further still, the HVAC system 102 may include an idle mode, where the furnace 104, the vapor compression system 72, and the blower 112 are shut off. In any case, at block 152, the control system 136 receives feedback from the temperature control device 142, the blower 112, the fan 122, the fuel supply system 124, the compressor 74, the expansion valve or device 78, and/or other components of the HVAC system 102 to determine a current operating mode of the HVAC system 102.

At block 154, the control system 136 determines whether the HVAC system 102 is operating in the cooling mode, in which the furnace 104 is inactive, but the plurality of tubes 114 is exposed to ambient air and the air flow 110 that has been cooled by the evaporator 106. If the HVAC system 102 operates in the cooling mode, the control system 136 may send a control signal to the valve 134 to adjust a position of the valve 134 to the open position, as shown in block 156. As set forth above, the valve 134 may include a normally closed solenoid valve. Therefore, the valve 134 may be in a closed position as a default position or otherwise biased toward the closed position. The control system 136 opens the valve 134 upon determining that the HVAC system 102 is operating in the cooling mode when the furnace 104 is susceptible to condensate accumulation. In some embodiments, the control system 136 may determine that the HVAC system 102 is not operating in the cooling mode, and the control system 136 may take no action to maintain the valve 134 in the closed position. In other embodiments, the control system 136 may send a control signal to the valve 134 to adjust the valve 134 to the closed position upon making a determination that the HVAC system 102 is not operating in the cooling mode, as shown in block 158. For example, the valve 134 may include a normally open solenoid valve, and thus, be adjusted to the closed position when the HVAC system 102 is not operating in the cooling mode. Alternatively, in embodiments where the valve 134 is a normally open solenoid valve, the control system 136 may be configured to adjust the valve 134 to the closed position when the control system 136 determines that the HVAC system 102 is operating in the heating mode.

As set forth above, embodiments of the present disclosure may provide one or more technical effects useful in increasing an efficiency of an HVAC system. For example, embodiments of the present disclosure are directed to a condensate drain system for a furnace of the HVAC system. Tubes of the furnace may receive or otherwise be exposed to ambient air when the furnace is in an inactive state. The ambient air may include moisture, which may condense upon transfer of thermal energy to an air flow conditioned by a vapor compression system, for example. As such, the furnace may include a drain conduit of the condensate drain system that is fluidly coupled to each tube of the furnace and is configured to direct the condensate from within the tubes toward a drain pan. A valve may be positioned along the drain conduit and between the tubes of the furnace and the drain pan to adjust a flow of the condensate from the furnace. Further, a control system may adjust a position of the valve based on feedback indicative of an operating mode of the HVAC system, such as a cooling mode, a heating mode, a ventilation mode, an idle mode, and/or another suitable operating mode. As such, condensate that accumulates within the furnace may be directed toward the drain pan, which may improve operation and/or increase an efficiency of the furnace, and thus, the HVAC system. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a furnace comprising a heat exchange tube disposed within an air flow path, wherein the heat exchange tube of the furnace is configured to direct a working fluid therethrough and place the working fluid in a heat exchange relationship with an air flow directed across the heat exchange tube of the furnace and along the air flow path;

a condensate drain system comprising a drain conduit fluidly coupled to an interior of the heat exchange tube of the furnace and a valve disposed along the drain conduit, wherein the valve is configured to control a flow of condensate from the interior of the heat exchange tube of the furnace to a drain via the drain conduit; and a controller communicatively coupled to the valve and configured to adjust a position of the valve based on feedback indicative of an operational state of the furnace.

2. The HVAC system of claim 1, wherein the working fluid comprises combustion gases, the heat exchanger tube of the furnace is configured to receive ambient air, and the HVAC system is configured to utilize the ambient air to generate the combustion gases in a heating mode of the HVAC system.

3. The HVAC system of claim 2, wherein the controller is configured to adjust the position of the valve toward a closed position based on the feedback being indicative of the heating mode as the operational state of the furnace.

4. The HVAC system of claim 1, comprising a heat exchanger disposed within the air flow path upstream of the heat exchange tube of the furnace relative to a direction of the air flow through the air flow path, wherein the heat exchanger is configured to cool the air flow in a cooling mode of the HVAC system.

5. The HVAC system of claim 4, wherein the controller is configured to adjust the position of the valve toward an open position based on the feedback being indicative of the HVAC system operating in the cooling mode.

6. The HVAC system of claim 1, wherein the controller is configured to adjust the position of the valve to a closed position based on the feedback being indicative of a heating call, and the controller is configured to adjust the position of the valve to an open position based on the feedback being indicative of a cooling call.

7. The HVAC system of claim 1, wherein the valve is a normally-closed valve.

8. The HVAC system of claim 1, wherein the furnace is configured to generate combustion gases as the working fluid.

9. A heating, ventilation, and air conditioning (HVAC) system, comprising:

a furnace comprising a tube configured to direct combustion gases therethrough, wherein the furnace is disposed within an air flow path configured to direct an air flow across the tube;

a drain conduit fluidly coupled to an interior of the tube of the furnace and configured to direct condensate from the interior of the tube to a drain;

a valve disposed along the drain conduit, wherein the valve is configured to control flow of the condensate from the interior of the tube of the furnace toward the drain; and a controller configured to adjust a position of the valve based on feedback indicative of an operational state of the furnace.

10. The HVAC system of claim 9, wherein the controller is configured to adjust the position of the valve toward a closed position based on the feedback being indicative of the furnace operating in a heating mode of the HVAC system.

11. The HVAC system of claim 10, wherein the furnace is configured to generate the combustion gases and direct the combustion gases through the tube to place the combustion gases in a heat exchange relationship with the air flow in the heating mode.

12. The HVAC system of claim 9, wherein the controller is configured to adjust the position of the valve toward an open position based on the feedback being indicative of the HVAC system operating in a cooling mode, and wherein the valve is a normally-closed valve.

13. The HVAC system of claim 12, wherein the controller is configured to control the furnace to not generate the combustion gases in the cooling mode.

14. The HVAC system of claim 13, comprising a heat exchanger disposed within the air flow path upstream of the furnace relative to a direction of the air flow along the air flow path, wherein the heat exchanger is configured to cool the air flow in the cooling mode.

15. The HVAC system of claim 9, wherein the interior of the tube is configured to receive ambient air.

16. The HVAC system of claim 9, wherein the feedback is indicative of a cooling call, a heating call, a ventilation call, or a combination thereof.

17. A heating, ventilation, and/or air conditioning (HVAC) system, comprising:

a furnace comprising a first heat exchanger disposed within an air flow path of the HVAC system, wherein the first heat exchanger of the furnace comprises a tube configured to receive ambient air, and the first heat exchanger of the furnace is configured to heat an air flow directed along the air flow path and across the tube;

a second heat exchanger disposed within the air flow path upstream of the first heat exchanger of the furnace relative to a direction of the air flow along the air flow path, wherein the second heat exchanger is configured to cool the air flow directed along the air flow path and across the second heat exchanger;

a drain system comprising a conduit fluidly coupled to an interior of the tube of the first heat exchanger of the furnace and comprising a valve disposed along the conduit, wherein the valve is configured to control condensate flow from the interior of the tube, through the conduit, and toward a drain; and a controller configured to adjust a position of the valve based on feedback indicative of an operational state of the furnace.

18. The HVAC system of claim 17, wherein the controller is configured to:

operate the furnace to generate combustion gases with the ambient air and direct the combustion gases through the tube of the first heat exchanger of the furnace to heat the air flow in a heating mode of the HVAC system;

suspend operation of the second heat exchanger in the heating mode of the HVAC system;

suspend operation of the furnace in a cooling mode of the HVAC system; and operate the second heat exchanger to cool the air flow in the cooling mode of the HVAC system.

19. The HVAC system of claim 18, wherein the controller is configured to adjust the position of the valve toward an open position based on the feedback being indicative of the HVAC system operating in the cooling mode, and the controller is configured to adjust the position of the valve toward a closed position based on the feedback being indicative of the furnace operating in the heating mode of the HVAC system.

20. The HVAC system of claim 19, wherein the valve is a normally-closed valve.

* * * * *